United States Patent [19]

Toyoshima et al.

[11] Patent Number: 4,808,283

[45] Date of Patent: Feb. 28, 1989

[54] METHOD OF PRODUCING A HIGH PURITY ALUMINUM-LITHIUM MOTHER ALLOY

[75] Inventors: Masayasu Toyoshima; Yoshiaki Watanabe; Yoshiaki Orito, all of Nagoya, Japan

[73] Assignee: Sumitomo Light Metal Industries, Ltd., Tokyo, Japan

[21] Appl. No.: 177,999

[22] Filed: Apr. 5, 1988

[30] Foreign Application Priority Data

Jan. 18, 1988 [JP] Japan ..... 63-6842

[51] Int. Cl.[4] ..... C25C 3/36

[52] U.S. Cl. ..... 204/71; 204/284; 204/290 R; 204/292

[58] Field of Search ..... 204/71, 292, 284, 290 R

[56] References Cited

U.S. PATENT DOCUMENTS

| | | | |
|---|---|---|---|
| 2,507,096 | 5/1950 | Dittmer | 204/71 |
| 3,607,413 | 9/1971 | Buzzelli | 204/71 X |
| 4,521,284 | 6/1985 | Tanabe et al. | 204/71 |

OTHER PUBLICATIONS

Journal of the Electrochemical Society, vol. 128, No. 12, Dec. 1981, pp. 2703–2705.

Chem. Zentralblatt, No. 43 (1957) p. 11999.

*Primary Examiner*—Donald R. Valentine

*Attorney, Agent, or Firm*—Flynn, Thiel, Boutell & Tanis

[57] ABSTRACT

A method of producing high purity aluminum-lithium mother alloys essentially free from sodium, potassium and calcium, which comprises electrolyzing mixed molten salts consisting essentially of lithium chloride and potassium chloride preferably under a cathodic current density in the range of 0.005 to 1 A/cm$^2$, using one or more hollow cylindrical solid aluminum cathodes, and thereby producing an aluminum-lithium alloy on the cathodes. In the method, the mixed molten salts may be composed essentially of 34 to 64 wt. % of lithium chloride and 66 to 36 wt. % of potassium chloride, and, optionally, 1 to 20 wt. % of sodium chloride based on a combined weight of the aforesaid two components. Preferably, throughout the electrolysis, the potential difference between the cathode and a two-phase ($\alpha+\beta$) aluminum-lithium alloy reference electrode is continuously measured and differentiated with respect to time and at the point of a sudden change in the differentiated value, the electrolysis is stopped.

6 Claims, 1 Drawing Sheet

METHOD OF PRODUCING A HIGH PURITY ALUMINUM-LITHIUM MOTHER ALLOY

BACKGROUND OF THE INVENTION

The present invention relates to a method of producing high purity aluminum-lithium mother alloys and more particularly to a method of producing aluminum-lithium mother alloys which are substantially free of contamination by calcium and alkali metals such as sodium, potassium, etc., other than lithium.

Generally, aluminum-lithium mother alloys have been heretofore produced by the method involving the following two basic steps.

(1) electrolytic production of metallic lithium; and (2) melting and casting.

In step (1), metallic lithium is produced by electrolysis of a molten salt mixture consisting of lithium chloride and potassium chloride. In step (2), the metallic lithium produced in the step (1) is added, in an amount needed to provide the desired mother alloy composition, to aluminum and melted together to obtain cast ingots of the mother alloys.

As high purity aluminum-lithium mother alloys suitable for use in practical applications, it is requested that they contain lithium in an amount of 10 wt.% or more and that sodium and potassium be each not more than 5 ppm and calcium be not more than 10 ppm.

Currently, commercially available electrolytic lithium with a high purity of 99.9% includes approximately 200 ppm sodium, 100 ppm potassium and 200 ppm calcium and thus it is impossible to produce high purity aluminum-lithium mother alloys using such lithium. Further, in order to produce superhigh purity electrolytic lithium with sodium not exceeding 50 ppm, an additional purification process of lithium salts or metallic lithium is needed.

When the purification of lithium is carried out by means of molten metal treatment with gas, serious loss of lithium is unavoidably occurs. Further, current efficiencies in the electrolysis of lithium in the conventional methods are relatively low, for example, 70 to 90% at most.

Further, in the conventional methods of producing aluminum-lithium mother alloys, remelting of the electrolytic lithium and aluminum is indispensable in the foregoing step (2), and in this remelting process, lithium is liable to deteriorate due to its extremely high activity. In order to prevent such an unfavorable deterioration, the remelting must be carried out under a controlled atmosphere of inert gas. Further, lithium tends to cause an unfavorable segregation in the course of solidification because of its low melting point and small density. Therefore, it is very difficult to produce constantly mother alloys with stable desired compositions by the conventional methods.

As a method to overcome the disadvantages hereinbefore mentioned, Assignee has previously developed a production process as discussed in U.S. Pat. No. 4,521 284, issued June 4, 1985 which process is characterized in that solid aluminum cathodes are used in the electrolytic preparation of aluminum-lithium mother alloy. In this process, alloying proceeds from a cathode surface toward a cathode central part with the progress of electrolysis and, in this procedure, expansion simultaneously occurs in the cathodes. With the progress of the expansion, cracks occur in the alloyed portion and gradually become larger, thereby causing serious problems as set forth below.

(1) When removing the resulting alloy, an electrolytic bath enters the cracks.

(2) Electrolyzing operation can not be stably performed due to variation in cathode current density.

(3) The produced ally is liable to fall off from the cathode surfaces.

(4) Large area is occupied by cathodes.

SUMMARY OF THE INVENTION

It is therefore a primary object of the present invention to eliminate the problems referred to above and, more particularly, to provide a method of producing a high purity aluminum-lithium mother alloy which comprises electrolyzing mixed molten salts consisting essentially of lithium chloride and potassium chloride, using one or more hollow cylindrical solid aluminum cathodes, and thereby producing an aluminum-lithium alloy essentially free of calcium and alkali metals other than lithium on the cathodes.

In the method, the cathodic current density may conveniently be in the range of 0.005 to 1 A/cm$^2$. In a preferred embodiment of the present invention, mixed molten salts consisting essentially of 34 to 64 wt. % of lithium chloride and 66 to 36 wt. % of potassium chloride are electrolyzed under a cathodic current density in the range of 0.005 to 1 A/cm$^2$, using the foregoing hollow cylindrical solid aluminum cathodes, and thereby producing high purity aluminum-lithium alloys essentially free from calcium and alkali metals other than lithium on the cathodes. The mixed molten salts may further contain sodium chloride in an amount of 1 to 20 wt. % based on the total amount of the aforesaid two components. In practicing the electrolysis according to the invention, preferably, an electrode made of aluminum-lithium alloy or an electrode having a coating of the aluminum-lithium alloy on the surface thereof is employed as an reference electrode and, throughout electrolysis, the potential difference between the cathode and the reference electrode is measured and differentiated with respect to time, and when the differentiated value is suddenly changed, the electrolysis is stopped.

DETAILED DESCRIPTION OF THE PREFERRED EMBODIMENTS

The present invention will now be described in detail hereinafter.

The inventors of the present invention have conducted various extensive studies and attempts and, as a result, arrived at the finding that when electrolysis of mixed molten salts of LiCl and KCl is carried out using the hollow cylindrical solid aluminum set forth above as cathodes, high purity aluminum-lithium alloys can be successfully formed on the aluminum cathodes without floating free lithium on the surface of an electrolytic bath and without depositing sodium, potassium and calcium. Further, in the formation process of such high purity aluminum-lithium alloys, problems such as cracking and falling off of the alloy from the cathode surface can be minimized. While the theoretical reason for this has not yet been certain, it is believed that when the hollow solid aluminum cathodes are used in the production of aluminum-lithium alloy, stress is generated in the direction toward the hollow portion of the cathodes and expansion of the cathodes occurs in the same direction, and, thereby, unlike the case of using cathodes of aluminum rod, the stress is released.

In order to achieve the effects contemplated by the present invention, the hollow cylindrical cathodes are conveniently so designed that when the lithium content of the desired aluminum-lithium alloy is represented as A wt. %, the ratio of the inner diameter to the outer diameter is at least the value calculated from the following equation:

$$\sqrt{1-\left[\frac{20.5}{100}\times(100-A)/(20.5+0.565\times A)\right]}$$

The above ratio is lower than the above value, the hole formed in the cathode will be filled by expansion of the cathode caused during the lectrolyzing process.

In the present invention, an electrolytic bath may be composed essentially of 34 to 64 wt. % of LiCl and 66 to 36 wt. % of KCl and the aimed objects can be readily realized within the specified ranges of the both components. In addition to the foregoing two components, NaCl may be added optionally in an amount of 1 to 20 wt. % with respect to the combined weight of the two components. The addition of NaCl depresses the melting point of a mixed salt of LiCl-KCl and lowers the electrical resistance of the electrolytic bath. The effects of NaCl are advantageous in that the electric power consumed in electrolysis is significantly saved. As long as the NaCl content is controlled in the range specified above, no deposition of sodium takes place, even if its content is increased. On the contrary, an addition of NaCl exceeding 20 wt. % increases an electrical resistance of the bath, whereas a low NaCl content of less than 1 wt. % does not show the effect in reducing the melting point of the bath.

Figure 1:
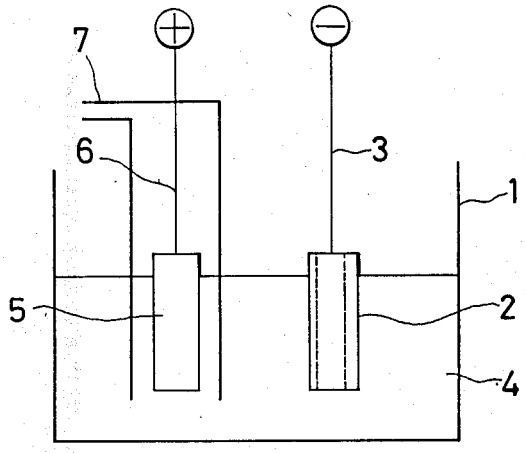
FIG. 1 is a schematic illustration showing the construction of an electrolytic cell used for carrying out the method of the invention.

FIG. 1 is a schematic illustration showing the basic construction of an electrolytic cell employed for embodying the present invention. Reference numeral 1 is the electrolytic cell containing mixed molten salts 4 of LiCl and KCl therein and an anode 5, for example, made of graphite, and a hollow cylindrical solid aluminum cathode 2 are immersed opposite to each other. Reference numerals 3 and 6 indicate a cathode lead and an anode lead. Reference numeral 7 is an outlet tube for collecting and venting chlorine gas generated on the anode 5.

In practically operating the electrolytic cell as described earlier, the cathodic current density is adjusted in the range of 0.005 to 1 A/cm$^2$. When the cathodic current density is less than 0.005 A/cm$^2$, the quantity of lithium deposited is small, thereby leading to an extremely low productivity of aluminum-lithium alloy which is not acceptable for industrial practice. While a current density greater than 1 A/cm$^2$ deposites free lithium on the cathodes and the alloying rate of lithium and aluminum is unfavorably lowered.

Further, in electrolyzing the molten salts set forth hereinbefore, an aluminum-lithium alloy reference electrode may be used with the hollow cylindrical cathodes of solid aluminum. In such a case, during the process of electrolysis, the potential difference between the cathode and the aluminum-lithium alloy reference electrode is continuously measured and the measured potential difference is differentiated with respect to time. Electrolysis is continued till the differenciated value changes suddenly and at the point of this sudden change, is stopped. Aluminum-lithium alloys thus produced are constantly uniform in their compositions. However, when the electrolysis is further continued after the end point, free lithium deposited on the cathode floats on the surface of the electrolytic bath, thereby resulting in a significant reduction in alloying yield of lithium. Thus, in practicing the invention, it is preferred that electrolysis operation be proceeded while continuously measuring the potential of the cathode using the reference electrode and ceased at the point of the sudden change in the potential of the cathode. The aluminum lithium alloy used in the reference electrode is required to be in the two phase ($\alpha+\beta$) state at the operation temperature and such a two-phase ($\alpha+\beta$) aluminum lithium alloy material may be used either in the whole or only on the surface part of the reference electrode. When the reference electrode is made using an aluminum-lithium alloy with an $\alpha$ single phase, the equilibrium potentials will widely vary depending on lithium contents of the used alloys and, thus, such an electrode lacks stability as the reference electrode. On the other hand, in the case of a $\beta$ single phase aluminum-lithium alloy, the alloy is very active and lacks stability in the electrolytic bath. Thus, when such a single phase aluminum-lithium alloy is employed as a reference electrode material, it is very difficult to obtain stable equilibrium potentials. Such properties make the single phase aluminum-lithium alloys inadequate for the use as the reference electrode materials. On the contrary, the aluminum-lithium alloy with the ($\alpha+\beta$) phase exhibits highly stabilized equilibrium potentials.

The use of the reference electrode provides the following merits:

(1) Because of the absence of the formation of free lithium, there can be achieved a high current density and a high alloying rate of lithium.

(2) High purity can be ensured in the resulting aluminum-lithium alloy due to the absence of deposition of sodium, potassium and calcium.

(3) In alloyed portions, a uniform $\beta$-Li-Al composition near to 20 wt. % Li-Al alloy can be always achieved.

(4) The alloying ratio of aluminum and lithium can be determined by controlling the electrolyzing time and there can be obtained high purity aluminum-lithium alloys containing up to 20.5 wt. % lithium. When lithium is alloyed with aluminum throughout the entire region of the cathode, aluminum-lithium alloys with lithium contents of about 18 wt. % to 21 wt. % can be obtained. When alloying of lithium with aluminum is restricted only to the surface region of the cathode, lithium content becomes low and, for example, lithium contents as small as 3 wt. % can be obtained.

As to the reasons why such high purity aluminum-lithium alloys are obtained, it is considered that lithium deposited electrolytically on the cathode surface diffuses into the solid aluminum and form a lithium-aluminum compound. The resulting lithium-aluminum compound effectively acts as a depolarizer, thereby reducing the decomposition potential of LiCl. In contrast, sodium does not have such a depolarizing effect and, thus, the decomposition potential of NaCl is unchanged. Further, when calcium is alloyed, the decomposition potential of $CaCl_2$ may be reduced due to deporalizing effect of the alloyed calcium. However, diffusion of Ca into the alloy produced is very slow as compared with diffusion of lithium. Therefore, actually the decomposition potential of $CaCl_2$ can not be changed. The decomposition potential of KCl is inherently higher than that of LiCl. In addition to this, the foregoing depolarizing effect of lithium further increases the difference in decomposition potential between LiCl and KCl. Based on such consideration, it is believed that only lithium is preferentially deposited and contamination of Na, K and Ca into the produced Al-Li alloy can be avoided.

Examples according to the present invention will now be described hereinafter. For the purpose of comparison, Comparative Example is also shown. In Examples and Comparative Examples, mixed molten salts 4 consisting essentially of LiCl and KCl were charged into the electrolytic cell 1 as shown in FIG. 1. An anode 5 made of graphite was suspended in the cell 1 and, as an opposite electrode, a cathode 2 designed in various configurations as viewed in FIGS. 2(*a*), 3(*a*) and 4(*a*), was also suspended.

Figure 2A:
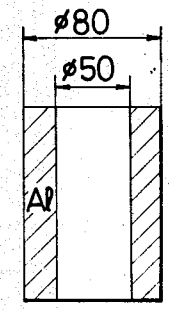
FIGS. 2(*a*)- and 3(*a*) are sections of cathodes used for electrolyzing according to the present invention and FIGS. 2(*b*) and 3(*b*) are sections of the respective cathodes after elctrolyzing.
Figure 2B:
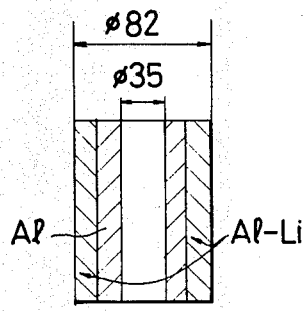

FIG. 2(*a*) shows a cathode of 99.7 wt. % (Na<5 ppm, K<5 ppm and Ca<5 ppm) according to one example of the present invention which had a hollow cylindrical configuration (outer diameter: 80 mm, inner diameter: 50 mm).

Figure 3A:
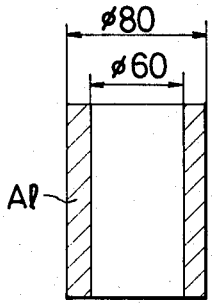
Figure 3B:
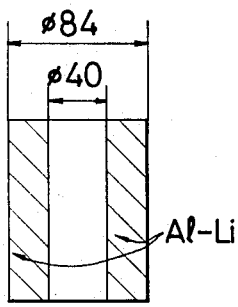

FIG. 3(*a*) shows a cathode of another example of the invention in which the cathode was made of the same 9.7 wt. % Al material as described above and had a hollow cylindrical form (outer diameter: 80 mm, inner diameter: 60 mm).

Figure 4A:
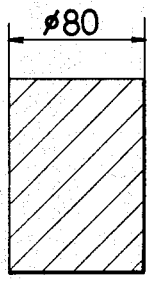
FIGS. 4(*a*) and 4(*b*) are section of a comparative cathode before and after elctrolyzing.
Figure 4B:
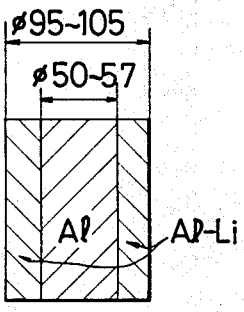

FIG. 4(*a*) shows a comparative cathode of the same 99.7 wt. % Al material as described above which had a cylindrical form of 80 mm in diameter.

EXAMPLE 1

An electrolytic bath of mixed molten salts consisting of 45 wt. % LiCl and 55 wt. % KCl was electrolyzed under a current density of 0.07 A/cm$^2$, using the cathode shown in FIG. 2(*a*). This electrolyzing ultimately resulted in an expansion of the cathode as shown in FIG. 2(*b*), namely, the outer diameter and the inner diameter were changed to 82 mm and 35 mm, respectively. Cracking did not occur and there was obtained a high purity mother alloy of 11.4 wt. % Li-Al in which the contents of Na, K and Ca were all less than 5 ppm.

EXAMPLE 2

The same electrolytic bath as described in Example 1 was electrolyzed under a current density of 0.10 A/cm$^2$, using the cathode shown in FIG. 3(*a*). This electrolyzing ultimately resulted in an expansion of the cathode as shown in FIG. 3(*b*), namely, the outer diameter and the inner diameter were changed to 84 mm and 40 mm, respectively. Cracking did not occur and there was obtained a high purity mother alloy of 20 wt. % Li-Al in which the contents of Na, K and Ca were all less than 5 ppm.

EXAMPLE 3

An electrolytic bath of molten salts consisting of 3 wt. % LiCl, 49 wt. % KCl and 8 wt. % NaCl was electrolyzed under a current density of 0.10 A/cm$^2$, using the cathode shown in FIG. 3(*a*). After electrolyzing, the outer diameter and the inner diameter of the cathode were changed to 85 mm and 40 mm, respectively. Cracking did not occur and there was obtained a high purity mother alloy of 19.5 wt. % Li-Al in which the contents of Na, K and Ca were all less than 5 ppm.

EXAMPLE 4

Electrolysis of an electrolytic bath made up of 45 wt. % LiCl-55 wt. % KCl was commenced at a current density of 0.1 A/cm$^2$, using a reference electrode of 13 wt. % lithium-aluminum alloy and a cathode of 99.99 wt. % aluminum (outer diameter: 80 mm, inner diameter: 60 mm, Na<5 ppm, K<5 ppm and Ca<5 ppm). In the course of the electrolysis, the potential difference between the cathode and the reference electrode was continuously measured and differentiated with respect to time. The potential difference gradually lowered with time while its differentiated value was approximately constant. However, after 265 minutes, a sudden change in differenciated value was detected and the electrolysis was stopped.

The mother alloy thus obtained consisted of 19.0 wt. % lithium-aluminum and the contents of Na, K and Ca were all less than 5 ppm. The current efficiency was not less than 99%. Further, after the rapid increase of the potential of the bath, electorolysis was continued without using the reference electrode. The resulting Al-Li mother alloy contains 44.7 wt. % of Li, 1000 ppm of Na, 70 ppm of K and 3100 ppm of Ca.

COMPARATIVE EXAMPLE

The same electrolytic bath as set forth in Example 1 was electrolyzed under a current density of 0.1 A/cm$^2$, using the cathode shown in FIG. 4(*a*). The alloying was proceeded from the outer surface. The outer diameter was expanded to 95–105 mm with many observable cracks. The composition of the resulting mother alloy was 11 wt. % Li-Al and the contents of Na, K and Ca were all less than 5 ppm.

In accordance to the method of the present invention, there were achieved the following representative advantages:

(1) Inclusion of Na, K and Ca can be reduced below 5 ppm with respect to each element.

(2) The outer diameter of a cathode is almost unchanged during the alloying process. In other words, since expansion toward the outer surface of the cathode is very slight, cracking hardly occurs in the outer surface.

(3) Since expansion of the outer diameter of a cathode is very slight, the cathode can be disposed in a narrow space in an electrolytic cell.

(4) When removing lithium-aluminum alloy produced, adhesion of an electrolytic bath to the alloy can be minimized since cracks on the alloy surface are very few and, thereby, contamination by the bath can be considerably reduced.

(5) Because of minimized change in the outer diameter of a cathode, variation in cathodic current density is negligibly small and operating conditions are stabilized.

(6) Since occurrence of cracking on a cathode surface is very slight, there is only a small possibility that the cathode material falls off from the cathode surface.

What is claimed is:

1. A method of producing a high purity aluminum-lithium mother alloy which comprises electrolyzing mixed molten salts consisting essentially of lithium chloride and potassium chloride, using one or more hollow cylindrical solid aluminum cathodes, and thereby producing an aluminum-lithium alloy essentially free from calcium and alkali metals other than lithium on said cathodes.

2. A method as claimed in claim 1 in which said electrolyzing is carried out under a cathodic current density in the range of 0.005 to 1 $A/cm^2$.

3. A method as claimed in claim 1 in which an electrode made of aluminum-lithium alloy or an electrode having a coating of said aluminum-lithium alloy on the surface thereof is employed as a reference electrode, said aluminum-lithium alloy used in said reference electrode being in the $(\alpha+\beta)$ phase at an electrolysis temperature, and said electrolysis is performed while measuring continuously the potential difference between said cathode and said reference electrode and then differentiating said potential difference with respect to time, and said electrolysis is stopped at the point at which differentiated value is suddenly changed.

4. A method of producing a high purity aluminum-lithium mother alloy which comprises electrolyzing mixed molten salts consisting essentially of 34 to 64 wt. % of lithium chloride and 66 to 36 wt. % of potassium chloride under a cathodic current density in the range of 0.005 to 1 $A/cm^2$, using one or more hollow cylindrical solid aluminum cathodes, and thereby producing aluminum-lithium alloys essentially free from calcium and alkali metals other than lithium on said cathodes.

5. A method as claimed in claim 3 in which said mixed molten salts further contain sodium chloride in an amount of 1 to 20 wt. % based on the total weight of said lithium chloride and said potassium chloride.

6. A method as claimed in claim 3 in which an electrode made of aluminum-lithium alloy or an electrode having a coating of said aluminum-lithium alloy on the surface thereof is employed as a reference electrode, said aluminum-lithium alloy used in said reference electrode being in the $(\alpha+\beta)$ phase at an electrolysis temperature, and said electrolysis is performed while measuring continuously the potential difference between said cathode and said reference electrode and then differentiating said potential difference with respect to time, and said electrolysis is stopped at the point at which differentiated value is suddenly changed.

* * * * *